United States Patent [19]

Hamilton

[11] 4,150,623

[45] Apr. 24, 1979

[54] METHOD AND APPARATUS FOR CORRECTING PRINTING PLATES

[75] Inventor: Raymond R. Hamilton, Piscataway, N.J.

[73] Assignee: American Hoechst Corporation, Somerville, N.J.

[21] Appl. No.: 766,276

[22] Filed: Feb. 7, 1977

Related U.S. Application Data

[63] Continuation of Ser. No. 659,837, Feb. 20, 1976, abandoned, which is a continuation-in-part of Ser. No. 600,580, Jul. 31, 1975, abandoned, which is a continuation-in-part of Ser. No. 449,476, Mar. 8, 1974, abandoned, which is a continuation-in-part of Ser. No. 354,118, Apr. 24, 1973, abandoned.

[51] Int. Cl.[2] ..... B41M 5/26; H05B 3/64

[52] U.S. Cl. ..... 101/466; 219/234; 346/1; 346/150; 401/1

[58] Field of Search ..... 346/165, 1, 140, 150, 346/466; 101/D 2, 463, 465, 467; 219/233, 234; 401/1, 2

[56] References Cited

U.S. PATENT DOCUMENTS

| | | | |
|---|---|---|---|
| 470,810 | 3/1892 | Lucas et al. | 346/165 |
| 951,103 | 3/1910 | Cornwall | 101/466 |
| 1,097,131 | 5/1914 | Kitsee | 204/2 |
| 1,350,734 | 8/1920 | Overlin | 219/70 |
| 1,810,212 | 6/1931 | Hinds | 219/235 |
| 2,173,741 | 9/1939 | Wise et al. | 346/140 |
| 2,292,119 | 8/1942 | Hackenberg et al. | 178/13 |
| 2,294,146 | 8/1942 | Wise | 101/D 2 |
| 2,311,047 | 2/1943 | Hagelin | 101/466 |
| 2,322,136 | 6/1943 | Jahoda | 96/92 |
| 2,477,887 | 8/1949 | McMillan | 219/234 |
| 2,494,412 | 1/1950 | Simkins | 401/2 |
| 2,503,679 | 4/1950 | Newman | 101/466 |
| 2,506,165 | 5/1950 | Mountcastle | 427/272 |
| 2,556,609 | 6/1951 | Arkless | 401/1 |
| 2,593,923 | 4/1952 | Roddin et al. | 101/D 2 |
| 2,692,935 | 10/1954 | Pearce et al. | 219/234 |
| 2,713,822 | 7/1955 | Newman | 101/D 42 |
| 3,279,366 | 10/1966 | Regan et al. | 101/458 |

FOREIGN PATENT DOCUMENTS

| | | | |
|---|---|---|---|
| 699792 | 12/1964 | Canada | 219/234 |

*Primary Examiner*—Clyde I. Coughenour
*Attorney, Agent, or Firm*—James E. Bryan

[57] ABSTRACT

A method and apparatus for adding ink receptive areas to or removing ink receptive areas from printing plates in which a consumable stylus, such as a graphite pencil "lead," or a non-consumable stylus, such as a copper wire, is brought into contact with the printing plate.

17 Claims, 4 Drawing Figures

METHOD AND APPARATUS FOR CORRECTING PRINTING PLATES

This is a continuation, of application Ser. No. 659,837, filed Feb. 20, 1976, now abandoned; in turn a continuation-in-part of Serial No. 600,580, filed July 31, 1975, now abandoned; in turn a continuation-in-part of Ser. No. 449,476, filed 3/8/74, now abandoned; in turn a continuation-in-part of Ser. No. 354,118, filed 4/24/73, now abandoned. The present invention relates to the correction of printing plates More specifically, the present invention relates to the touch-up of printing plates by fusing ink receptive substances to the surface thereof or removing ink receptive substances therefrom. Still more specifically, the present invention relates to the touch-up of lithographic plates by transferring ink receptive substances to the surface of lithographic plates, thereby converting areas of the plate that are not ink receptive to areas that are ink receptive, or removing ink receptive substances from the surface of lithographic plates, thereby converting areas of the plate that are ink receptive to areas that are not ink receptive.

In the conventional lithographic printing process, an image-carrying plate is mounted on a printing press. Rollers carrying ink and water come in contact with this plate. Ink is deposited on all image areas and water is deposited on all non-image (background) areas. Ink from the image areas of the plate is then transferred to a blanket, which, in turn, transfers the ink, by contact, onto the paper sheet. The resulting printed sheet is a duplicate of the image on the original metal plate.

A lithographic printing plate, as used in the aforementioned lithographic printing process, can consist of a support sheet, of aluminum, other suitable metals, resinous materials, paper-type materials and the like, which is treated and coated with a light sensitive material. To prepare a plate for the press, this light sensitive coating is exposed in contact through a film transparency or by projection through a film transparency or by reflex from an original, using actinic light, and then processed to yield a positive image of the subject matter. Due to imperfections in the original or the film copy or the light-sensitive emulsion on the plate or to problems connected with plate make-ready, defective image areas can readily occur. Any portion of the image which is missing on the plate will cause a void in the printed image on the printed sheet or unwanted ink receptive material on the plate will cause undesirable extensions of the image areas or spots on the printed sheet and, in the absence of a correction technique, a new plate might be required.

In the present state of the lithographic art, there are two popular methods for adding image to an offset plate. One is a chemical tusche, which is only a stop-gap measure at best since its lasting ability on a press is limited; the second is the use of a needle to produce small depressions in the metal plate. In the latter instance, by first dipping the tip of the needle such as for instance in printing ink, an ink receptive correction is produced. Neither the use of the tusche nor the needle technique is satisfactory. As mentioned above, permanence of the "tusched in " image is often not as good as that of the remainder of the image. Also, corrections are, at times, hard to apply and, thus, it becomes very difficult to equal the quality of the remainder of the work. "Needled in" images, on the other hand, often carry and transfer ink in a different manner than the rest of the image, thus, such corrections become objectionably visible in the final print.

Corrections to remove excess ink receptive material, existing as undesirable extensions of image characters or unwanted spots of ink receptive material, are also a problem in the present art. Removal of such unwanted ink receptive materials is presently done by scraping or simply erasing the material or by using strong chemicals. The problems of damage to the base material and mainly the lack of accurate control, particularly where small areas are to be removed in close proximity to a desired image area, are readily apparent.

Yet corrections are frequently most desirable and economically significant. In multicolor work, when a press run has been partly completed and a defect appears in one of the printing plates, the need to stop the press and make a replacement plate causes a serious economic loss. Therefore, a method to make a fine-detailed, durable correction to the defective plate relatively quickly while it is still mounted on the press is most desirable. A correction technique meeting all the criteria enumerated below has great economic significance.

In another situation, in a plate made by multiple, successive exposures, through a process known as "step and repeat," as many as thirty or more exposures may be required. This can take up to two hours or more to accomplish. If but one part of one image is defective, the entire plate may be useless, unless it can be corrected to a degree of fineness and permanence at least equal to the rest of the plate.

Rogers, U.S. Pat. No. 1,306,631, is an example of control of voltage and/or current. Applicant also controls voltage and current in the inventive system but does not claim those features alone to be the invention. Rogers has an electrically heated wire stylus which is held taut over a sharp edge "to present substantially a point contact" to scorch a record on paper or other heat sensitive substance. The substance to be marked is not made part of the circuit nor is ink receptive material transferred from stylus to a printing plate or vice versa as in the present invention.

Newman, U.S. Pat. No. 2,713,822, makes a printing plate by transferring oleophilic wax compound from a coating on the underside of an electrically conductive paper which has an electrically conductive resistance layer coated on the upper face thereof. Electrical impulses from a conductive stylus trace a transmitted facsimile on the upper face. The electric impulses cause the transfer of oleophilic material to a planographic printing plate support, preferably paper, which thereupon becomes a plate. The stylus is conventional, therefore a non-consumable metal stylus.

Taking the add mode first and comparing it with Newman, the patentee employs an electrical circuit and a planographic plate and so does applicant. After that there is a difference. The patentee's electrically conductive stylus, while never specified, is derived from the facsimile recording art and is made of a permanent, non-consumable material. Applicant's is of ink receptive material which is consumed during use.

Newman transfers ink receptive material by employing a specially coated 3-layer paper, the top layer of which is semi-conductive, the core highly conductive, and the bottom layer a fusible oleophilic wax compound. Applicant employs no such materials.

Further, the patentee needs and uses an electroconductive platen under his planographic plate. Applicant normally corrects (adds to) metal plates and does not use an electroconductive platen under the planographic plate.

Newman uses a complex multilayered composite sheet to transfer a wax marking to his plate. Although an electrical contact is said to cause the transfer, no reason can be seen why stylus pressure along on a simple sheet of carbon paper would not be equally effective.

In contrast, applicant goes directly to the printing plate with a stylus which is at once electrically conductive and capable of transferring, with suitable current, a permanent ink receptive surface. In the absence of current the marking on the plate is temporary, wearing off in relatively few impressions. Nothing in the Newman patent describes or even suggests the simple but unexpected method applicant uses to add ink receptive material.

In the delete mode, there is a greater difference from Newman. While the stylus is non-consumable in both cases, there is no further significant similarity. The three-layer special wax coated paper is used to add oleophilic material by transfer. In applicant's device the stylus contact removes material by vaporization.

Regan et al, U.S. Pat. No. 3,279,366, is "an example of alternate use of a writing instrument, transfer sheet, etc." and indeed does not deal with the use of an electrical circuit plus an electrically conductive stylus to either add or delete ink receptive material to or from a printing plate. A planographic printing plate is prepared by coating an aluminum sheet with a very thin coating of sodium sulfide which is overcoated with lead acetate. Contact pressure with exposed silver halide negative material through a one-step development and fixing both creates an oleophilic image on the aluminum plate.

Roddin et al, U.S. Pat. No. 2,593,923, prepare a facsimile transmitting master on a prepared blank by pressure transfer of conducting marks from a uniform coating adhered to a paper support. The pressure transfer is caused by either a hand held stylus or a typewriter key impacting the upper surface of the coated paper very similar to carbon paper. No electrical circuit is employed in the transfer. Nor are corrections made to a printing plate; there is no printing involved.

Cornell, U.S. Pat. No. 1,892,099, discloses the use of an electrical circuit and a metal stylus to effect photographic retouching of a screened positive transparency. The general area where it is desired to reduce dot size is treated with potassium ferrocyanide (to which silver is inert). By spot application of current the ferrocyanide is reduced to ferricyanide which reduces silver dot size by chemical action. There is no addition to or removal of ink receptive material from a printing plate and in this fundamental regard, Cornell is entirely different and does not suggest the present invention. Moreover, the apparatus shown would be incapable of adding ink receptive material regardless of current and voltage, as the stylus is of metal.

Newman, U.S. Pat. No. 2,655,864, discloses a paper printing plate coated with coagulated carboxymethyl cellulose. This is a direct image plate which is "typed, imprinted or inscribed with the desired image" which is composed of ink-attracting material. There is no mention of the use of an electrical circuit to prepare the plate, and so no relationship to the present invention.

Dalton, U.S. Pat. No. 3,255,039, makes a facsimile recording blank which reveals an image when on a recording drum as a result of an electrical current. The recording blank has the usual conductive backing of dark color. What is novel is signal disruptable coating of contrast color. A chemical blowing agent is added to the coating formulation which is heated sufficiently during its drying to form "a multiplicity of microscopic pockets or channels," i.e., foamed. When acted upon by the metal stylus of a facsimile machine, the coating fractures and reveals the contrast color of the conductive layer below, thus showing a readable message. No material is added or removed by the action of the stylus.

The comments made concerning the Cornell patent are applicable here, although to a lesser extent because the facsimile machine is much more complex. The Dalton machine could not correct printing plates by transferring ink receptive material.

Wise, U.S. Pat. No. 2,294,146, is concerned with blanks of facsimile recording. As a result of contact with a stylus in an electrical circuit, carbon particles which have been impregnated in a black support sheet are caused to move upwardly to a thin white overcoating layer and so reveal a visible trace of the movement of the stylus. As in the previous facsimile blank patents, no material is transferred from the stylus to the surface it touches. Thus, the apparatus is different and the action is different from that of the present invention insofar as applicant's stylus is of ink receptive material which is transferred to a planographic plate.

Dalton, U.S. Pat. No. 3,132,584, discloses no transfer of ink receptive material to the plate. Apart from the detail of the recording blank, the same comments made concerning the Wise patent are applicable.

Overlin, U.S. Pat. No. 1,350,734, is an example of material deposition. Overlin uses an electrical circuit in conjunction with a metal stylus and solenoid to "mark upon metal electrically" . . . "for use of mechanics in machine shops and garages in marking for identification their tools and parts of machines."

Overlin is not an example of deposition. He states explicitly (page 1, lines 73–75) that his "marking point" is copper, or harder or more durable metal such as platinum, which would not lend itself to deposition upon "tools and parts of machines" but rather perform the intended function of cutting permanent gouges in "the metal to be inscribed" (column 1, lines 15–17). Such markings, human nature apparently being no different in 1920 than today with regard to tools, were intended to facilitate proof of theft. The "erasure" of such markings is nearly impossible to effect and would tend to discourage unauthorized borrowing.

Overlin's device would not accomplish the selective deposition of ink receptive material performed by the present invention. Nor is the substitution of an ink receptive stylus obvious from consideration of Overlin.

Hinds, U.S. Pat. No. 1,810,212, is also an example of deposition. The comments given concerning Overlin are equally applicable here as Hinds discloses a tool for the same purpose: marking, and additionally cutting, soldering and light annealing.

Hinds mentions an optional carbon electrode, but this in no way changes the operation of this device or enables it to be used to add ink receptive material to printing plates. Hinds removes, he does not deposit.

Dalton, U.S. Pat. No. 3,079,859, is an example of material deposition. Dalton costs a metal backing with a coating composition containing electrolytic salts in a water soluble binder. He finds that the metal backing, when acting as anode, reacts "with an ingredient of the salt solution to produce a deposit" on the metal which will be ink receptive. This electromechanical action is in response to electrical signals through a pointed stylus cathode. "After recording, the coated surface is washed with water leaving the areas where current has been applied visible as colored slightly raised areas . . . which after drying will be receptive to ink."

It is true that Dalton refers to "deposits." But all of the material was initially present in the electrolytic coating. Hence the action is one of electrolytic conversion, not deposition. Dalton's "deposit" is what remains after washing. In contrast, in the present invention, the action is literally deposition by the electric current to transfer ink receptive material.

Pudelko, U.S. Pat. No. 1,771,272, is an example of materials used. The device is a simple mechanical recording apparatus in which, as the advance, a graphite roller is substituted for an ordinary lead pencil to reduce wear. There is no electrical circuit nor electrochemical deposition of ink receptive material. As mentioned earlier, marking a printing plate with a lead pencil in the absence of an electric circuit produces an extremely impermanent, useless image.

It is an object of the invention to overcome the aforementioned shortcomings of previous plate correction methods and provide a method and apparatus which will have the following desirable characteristics:

1. No special base preparation is needed.
2. No special chemistry is required.
3. Drying is not necessary.
4. The correction can be made on most types of printing plates.
5. The apparatus is inexpensive to operate, simple to use, and unlike most chemical compositions has no shelf life problems.
6. The method is compatible with alcohol dampening systems.
7. The correction, by addition of ink receptive material, is permanent.
8. The correction material, added to a plate, is compatible with standard lithographic ink, plate cleaners, fountain solutions, etches, and other chemcials that are an integral part of the lithogrphic process.
9. The correction, whether by addition or removal of ink receptive material is permanent and especially can be made on the press without removing the plate.
10. The corrections can be made at any stage through the full lithographic cycle.

The foregoing objectives are achieved by a device which applies an ink receptive material to be fused to the surface of a lithographic plate or removes an ink receptive material from the plate at precisely the point or areas to which it is desired to make th plate ink receptive or non-ink receptive. U.S. Pat. No. 1,350,734, to Overlin, and U.S. Pat. No. 1,810,212, to Hinds, show electrical apparatus with a power source and stylus to mark, score, engrave, or cut into metal. The device of the present invention, when using a metal stylus, effects deletion by vaporization without change or harm to the metal surface. In particular, as is required for a satisfactory deletion, there is no printable residue after use of the device.

One such apparatus of the invention is an electrical device using a low voltage, in which an electrical spark or arc is produced between the metallic plate and the tip of an electrically conducting stylus, for instance of a graphite composition which, through the action of the current in the area of contact, produces ink receptive areas. By the action of the current between the pencil-shaped graphite composition and the plate surface, a small portion of carbon transfers to the plate at precisely the spot of contact, whereby it is bonded and permanently adhered, thus resulting in ink receptive areas.

In the correction of plates by removal of ink receptive material, the same device is employed under essentially the same conditions, except that a pencil-type stylus of a conducting material, such as a copper conductor, is substituted for the graphite or other consumable-type stylus.

The following specific examples will aid in the understanding of the invention.

Using either a DC or an AC source, one of the essentials both for adding and for deleting images is to maintain the voltage and current within defined parameters. To add ink receptive material, it has been found that the initial voltage required to strike an arc should be between about 10 and 50 volts and preferably between 15 and 24 volts. For example, when using a conventional graphite pencil "lead" as the stylus to add image to a conventional aluminum lithographic plate which always carries a thin insulating film on its surface, it has been found that a voltage below about 10 volts is insufficient to create an effective arc between the stylus and the plate. By the same token, a voltage above 50 volts, while more than adequate to produce an effective arc, may burn through the aluminum support or at least burn and damage the support if this level of voltage is maintained. In addition, at the higher voltage, the graphite builds up on the plate too rapidly for satisfactory operation. Accordingly, the voltage should be initially at about 24 volts. The circuit has been designed so that once the arc is produced, the voltage drops and is sustained ideally between about 2.5 to 20 volts, for optimum operation. A copper or chromium plate with no oxide film requires an initial voltage no higher than the sustaining voltage, if no insulating film is present.

The sustaining current or current during graphite transfer should be between about 0.5 and 6 amps and preferably between 1.5 and 3 amps. It has been found that, at current levels above about 3 amps, excessive heating of the stylus may occur during continued use, thus causing fusing of the graphite to the support of holder of the stylus means.

With a DC source, it was also found that the sustaining power should be maintained between about 2 and 40 watts and preferably between about 6 and 15 watts.

On the other hand, deletion or removal of ink receptive material from an aluminum plate also can be effectively carried out, with the same power supply using essentially the same operating parameters, by simply substituting a conventional copper conductor for the graphite stylus. Specifically, a 0.02 inch diameter copper wire can be utilized as a stylus. It was found that with such stylus at voltages at about 12 volts, it was difficult to produce an effective arc while voltages above about 15 volts caused the stylus to weld or stick to the plate. Satisfactory deletion was found to be obtained by initiating the arc at about 15 volts and using a sustaining voltage of about 5 volts while holding a sustaining current of about 0.5 to 3 amps.

For a better understanding of the present invention, together with other and further objects, advantages, and capabilities thereof, reference is made to the attached drawings wherein.

Figure 1:
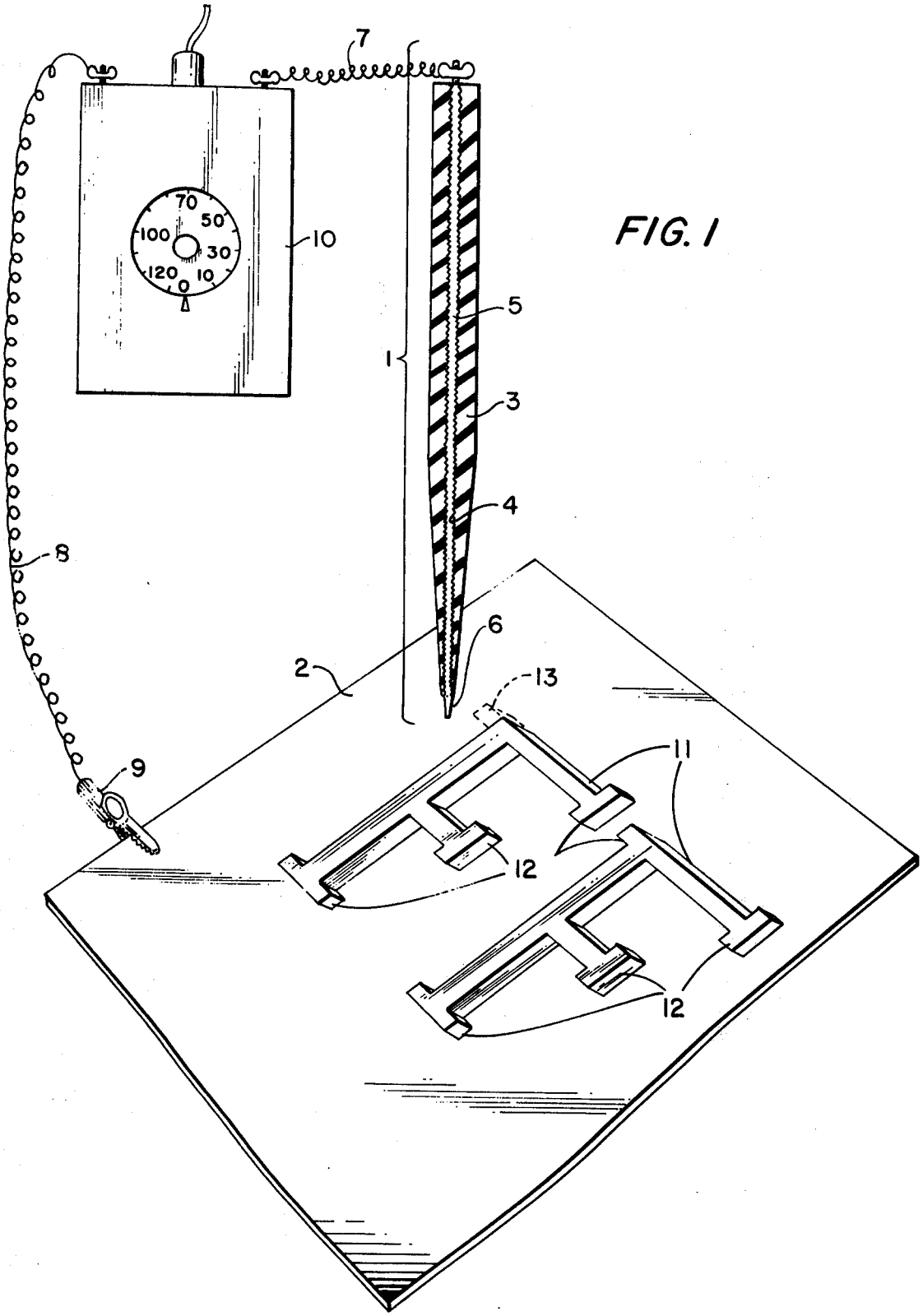
FIG. 1 shows the correction device, partially in section, of the present invention together with a perspective view of a portion of a lithographic printing plate.

With reference to the drawings, there is shown in FIG. 1 the pencil 1, which with certain exceptions appears similar to a conventional lead pencil, together with a perspective view of a portion of a lithographic printing plate 2. The pencil is intended to be held by sheath 3 in the conventional manner for holding a writing implement, such as, a pen, pencil or other marking device. The sheath 3 is composed of insulating material. The outer sheath may be straight or tapered to afford a better grip for the fingers. The inner surface 4 of the sheath is cylindrical so that the carbon stylus material 5 may be conveniently inserted. The stylus material may be advanced down its cylindrical channel as it is consumed (as shown hereinafter). The tip of the stylus 6 is sharpened to a fine point after it has emerged from the sheath in order to facilitate its use. Whereas electrical lead 7 to the stylus may be permanently attached, the electrical lead 8 to the plate 2 is more conveniently temporary, as, for example, an alligator clip 9. A power source 10 is connected to the electrical leads 7 and 8.

The small portion of a plate 2 bearing an image 11, shows the letter F with serifs 12. The position of the missing serif 13 is shown by a dotted outline. The extreme tip of the correction device 6 is shown proximate to the missing serif.

It is to be understood that the proportions shown in the illustrative drawing of the device are not limiting.

With reference to FIG. 1, the tip of the carbon stylus is shown out of contact with the plate surface. When the stylus touches the plate, the circuit is completed by withdrawing the stylus, immediately an arc is formed, and a small portion of the stylus tip transferred to the plate at the point of contact. In use, the operator touches the plate lightly and momentarily withdraws the tool. He quickly learns by practice how to handle the tool to get the desired results.

Figure 2:
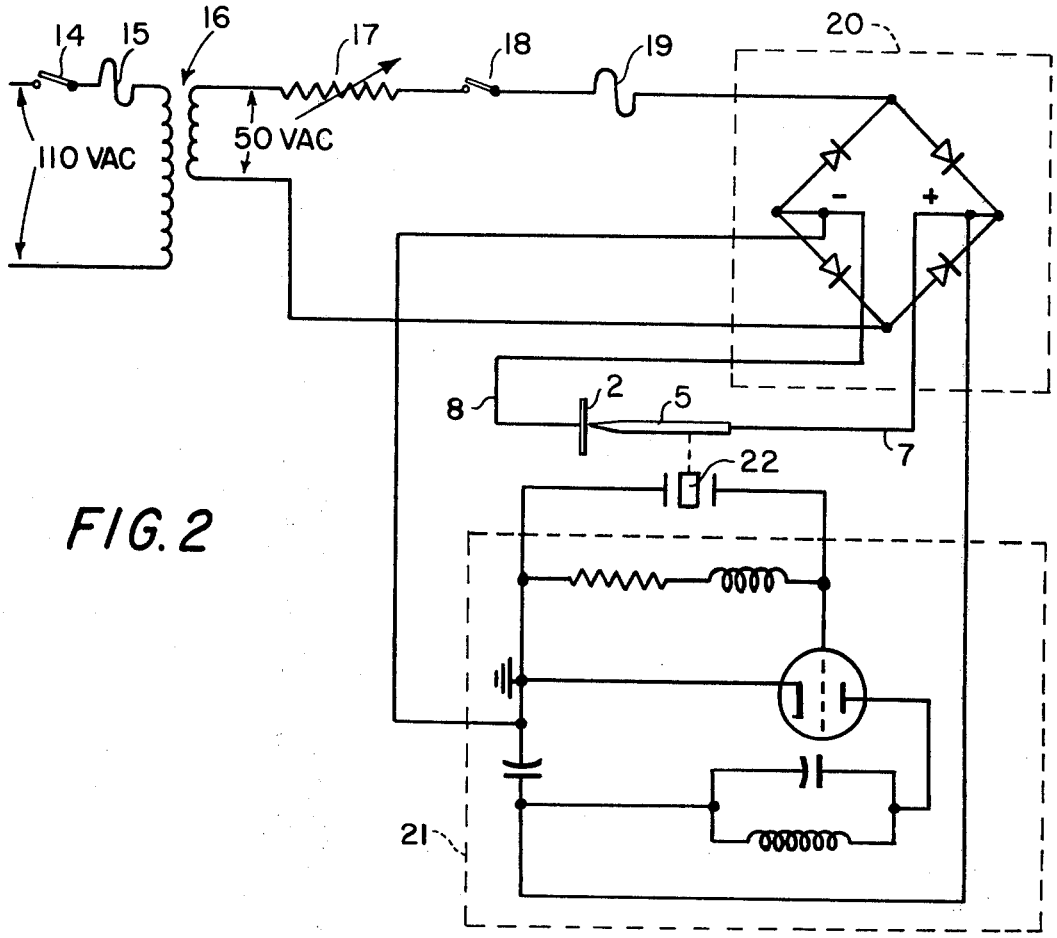
FIG. 2 is a simplified, electrical schematic of an embodiment of the device of the present invention.

As can be seen from FIG. 2, power is supplied to the correction or marking device of the present application from a suitable AC source. The supply lines from the AC source are provided with an appropriate switch 14 and a fuse 15. The supply lines are connected to a suitable step-down transformer 16. Step-down transformer 16 preferably reduces the source voltage to a voltage of approximately 50 volts AC. For convenience, variable voltage can be supplied by a rotary voltage divider 17 or other appropriate voltage reducing device, such as, a variable, series resistor. The power supply itself can also be provided with an appropriate switch 18 and a fuse 19 to protect the voltage supply from overloading. Rectifier 20 converts the AC voltage to an equivalent DC voltage. Rectifier 20 may be a solid-state, full-wave rectifier, as shown, or it may be an electron tube rectifier or an electromechanical device. Leads 7 and 8 from rectifier 20 are connected to a carbon stylus 5 and the lithographic printing plate 2, respectively. While it is not essential to the operation of the device of the present invention, the carbon stylus can be equipped to vibrate for producing a quicker and more consistent arc between the carbon stylus and the lithographic plate than can be obtained by manual manipulation. Various vibrator means can be utilized for this purpose. For example, a simple crystal oscillator may be used. In this instance, the DC voltage supply is connected to a suitable oscillator 21 which oscillates a crystal 22. The crystal 22 is, in turn, mechanically coupled to the carbon stylus 5. It is obvious that other means of vibrating the stylus can be utilized. For example, a crystal can be directly connected to the AC source or to the stepped-down AC supply. Similarly, a simple magnetostrictive vibrator may be coupled to the stylus 5. Other suitable electrical components may be included in the circuit, as will be apparent to one skilled in the art. It should be recognized that different power supplies may be used without departing from the spirit of the invention.

Since voltage requirements will vary, for the various type corrections, as previously indicated, a voltage and regulator should also, preferably, be provided. Dependent upon the configuration of the power supply, no control means may be needed to provide current and voltage in a suitable range for the practice of this invention. Exemplary is a 24 volt battery connected directly to stylus and plate. Alternatively, a fixed control means such as a transformer with or without a rectifier may suffice. Although convenient in coping with a positive wide variety of current sources, a variable control means such as a variable resistor is not absolutely necessary if current and voltage is suitable in its absence.

As a matter of convenience, the plate is shown as the ground connection but is is possible to have the stylus grounded and the plate as the positive electrode. Also, while the DC supply is shown, an AC supply can be substituted therefor in this invention.

Figure 3:
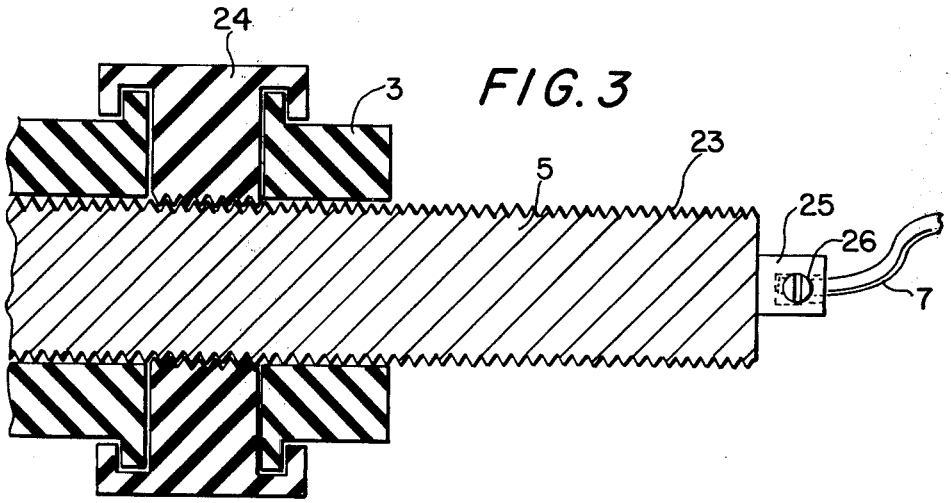
FIG. 3 is a partial view, partially in section, of a modified form of the device of the present invention.

While it is, again, not essential to the operation of the present invention, means should be provided for conveniently advancing the carbon marker or stylus means 5 in its holder 3. Obviously, this can be done by simply having the carbon stylus 5 fit snugly in the holder 3 and sliding the carbon stylus through the holder by hand. However, more elaborate means for advancing the carbon stylus can be provided as shown in FIG. 3 of the drawings. In accordance with FIG. 3, the carbon stylus 5 is provided with appropriate screw threads 23. Again, the carbon fits rather snugly into the holder 3. However, the holder 3 is provided with advancing nut 24, which is internally threaded so that simply by turning the annular advancing nut, the carbon will be advanced through holder 3. In this instance, in order to permit the use of as much of the carbon as possible, a different means of connecting electrical lead 7 to the carbon stylus may be provided as shown in FIG. 3. For example, a mounting post 25 is bonded to the top of the carbon and the electrical lead simply fits into a hole in mounting post 25 and is held therein by means of set screw 26. Thus, the lead 7 can be advanced down into the holder 3 to substantially the bottom of the holder if desired. It, of course, is obvious that other arrangements of advancing means can be provided. For example, the carbon 5 need not be threaded, but the advancing nut 24 can be threaded and fit tightly around the carbon 5. In this instance, the carbon will be advanced, although not as positively as if the carbon itself were threaded. Another variation would be where the advancing nut 24 is spirally knurled on its inside in the same fashion as if threaded. This will permit the carbon stylus 5 to be smooth rather than threaded.

Figure 4:
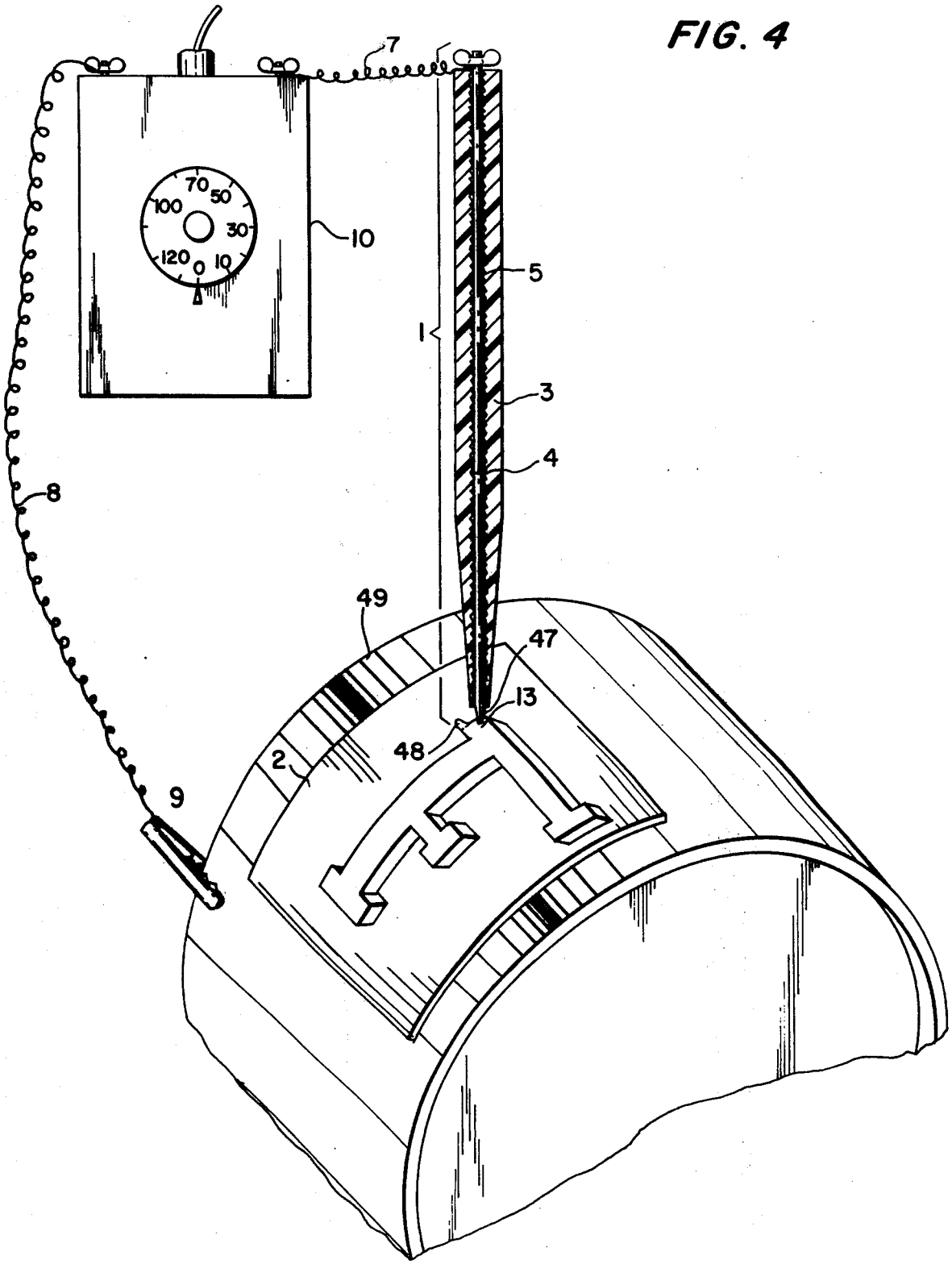
FIG. 4 shows the correction device utilized for deleting ink receptive material attached to a plate holding device such as a plate cylinder of a printing press.

FIG. 4 is the same as the system illustrated in FIG. 1 except that a copper stylus 47 is utilized for deletion of the overextended portion 48 of serif 13. Additionally, the plate 2 is a printing plate, and the clip 9 is attached to a conductive back-up plate 49, in this instance the metal mounting drum of a lithographic printing apparatus.

Suitable stylus materials are for adding image, for instance, those supplied by the pencil lead industry for drafting, drawing, accounting and general use. They range in hardness from 2B to 9H, the hardness designations being those which are commonly used in the pencil industry. Carbons ranging in thickness from 0.020 inch to 0.080 inch are useful and will work. In general also, the thinner carbons are better for fine, critical work, while coarser work can generally be done better with thicker carbons.

Other stylus compositions are suitable for addition of ink receptive materials. Thus, other known ink receptive substances are carbon, copper and its alloys, brass and bronze, silicon, etc., when in finely powdered form and compounded with inert high melting filters, such as clays and with binders of waxes, fats or fatty acids in much the same manner used in the manufacture of "lead" pencils. (See Encyclopedia of Chemical Technology, 2nd Edition, Volume 4, page 331).

The deposit of ink receptive material is fused to the printing plate as in the case of the graphite compositions described before.

It has been shown (R. A. C. Adams, International Bulletin #73, for the Printing and Allied Trades, Jan. 1956, pages 20–23, inc.) that nickel can also become relatively oleophilic in the simultaneous presence of oleic acid and water, so that this metal can be added to the group of ink receptive materials to be handled by compounding with fillers and lubricants and then formed into pencil shaped electrodes.

The following illustrative examples show the addition of ink receptive material to various printing plates.

EXAMPLE I

An "ENCO O N-25" negative working presensitized lithographic plate, manufactured by Azoplate Division of American Hoechst Corporation, was exposed and developed conventionally. Upon examination, holes in the image area were observed because of faults in the film used for exposure. Using the plate correction device in the add-on image mode, all holes could be filled in by repeatedly touching these areas with the tip of the stylus and withdrawing it to create an arc. Additionally, letters outside the image areas were artificially created for test purposes. The plate was then subjected to many thousands of impressions. Examination showed that all of the areas added on by the correction device remained undamaged. Printing was then continued until the original image showed signs of wear. Re-examination at this point revealed that the images created by the correction device were still intact.

EXAMPLE II

Following the procedure of Example I, additional aluminum plates from other sources were treated with the plate correction device. In all cases, the device and technique were used successfully and when the treated plate was subjected to length of run testing, the corrected areas outlasted the uncorrected areas. The plates that were tested in this manner and their manufacturers are:

| Manufacturer | | |
|---|---|---|
| Azoplate Division of American Hoechst Corporation | N-2 | Negative, diazo, additive |
| | PA 200 | Positive, diazo subtractive |
| | N-200 | Negative, anodized, subtractive |
| Minnesota Mining and Manufacturing Company | R | Negative-diazo additive, |
| | K, S, T | Negative, diazo, subtractive |
| Polychrome Corporation | FG | Negative |
| DuPont Corporation | Lydel | Negative, photopolymer |
| Eastman Kodak Corporation | LN | Negative, anodized, photopolymer |
| Western Lithoplate | | Negative, Wipe-On Plates |

EXAMPLE III

A bimetallic plate, manufactured by Printing Developments, Inc., Division of Time, Life, Inc., was previously exposed, developed and etched. The resulting printing plate has a copper image on a stainless steel support. Following the procedure of Example I, corrections were made on the stainless steel. Also, a specimen additional treatment of the stainless steel was made to create a new image for test purposes. A number of printing impressions was made with the corrected plate. No breakdown of image was noted. To further check the durability of the image, both the normal copper image and the carbon treated corrections were rubbed with a pencil eraser using the same pressure in each case. No change was noted in the carbon areas, but the normal copper image was damaged, thus proving the durability of the corrections.

EXAMPLE IV

Using the lithographic plate of Example I, a good quality addition was achieved using a plate correction device having a pencil with "H" hardness lead. The DC voltage fluctuated between 14 and 16 at the stylus. The current fluctuated between 0.5 and 0.7 ampere. The initial arcing voltage was 26 volts.

EXAMPLE V

Using the lithographic plate of Example I, ink receptive material was deleted using a plate correction device having a stylus of 0.02 inch diameter copper wire. The voltage of the stylus fluctuated between 10 and 18 volts and the current fluctuated between 0.3 and 0.6 ampere. The initial arcing voltage was 26 volts.

It will be obvious to those skilled in the art that many modifications may be made within the scope of the present invention without departing from the spirit thereof, and the invention includes all such modifications.

What is claimed is:

1. A system for correcting an imaged lithographic electrically conductive printing plate by the transfer of an ink receptive material to a non-imaged area of said plate, said system comprising:

(A) An elongated stylus composed of solid ink receptive material selected from the group consisting of carbon, compositions containing finely divided copper and its alloys, and compositions containing finely divided silicon, said stylus having a small cross-sectional dimension at a tip thereof and said tip being adapted for electrical contact with said lithographic plate, (B) A source of electrical energy having a potential within the range of about 2.5 and 50 volts, said source being electrically connected to said stylus of ink receptive material and said source being adapted for electrical connection to said lithographic plate, and (C) control means operatively connected to said source of electrical energy and being adapted to maintain a current below about 6 amperes and a power within the range of about 2 and 40 watts at said stylus tip sufficient to strike an arc when said tip is brought into contact with said non-imaged areas of said lithographic plate and said source of electrical energy is connected to said plate, but insufficient to burn said plate, whereby said ink receptive material is caused to transfer to said non-imaged area of said plate by intermittent contact of said stylus tip with said non-imaged area of said plate.

2. The system of claim 1 wherein said ink receptive material is carbon in the form of particles in a binder.

3. The system of claim 2 wherein the carbon is graphite.

4. The system of claim 1 including means for adjusting said control means.

5. The system of claim 1 wherein said ink receptive material is electrically conductive and partially meltable.

6. A method for correcting an electrically conductive lithographic printing plate comprising contacting said plate with one end of an elongated stylus composed of ink receptive material and having a small cross-sectional dimension at one end thereof at which point the correction is to be made, said stylus and said plate being connected to a source of electrical energy sufficient to cause an electrical arc between said stylus end and said plate when said stylus end is contacted with said plate and then withdrawn, but said source of electrical energy being insufficient to burn said plate, whereby a quantity of ink receptive material is transferred from said stylus to said plate.

7. The method of claim 6 wherein said source of electrical energy has a potential within the range of about 2.5 to 50 volts and is adapted to maintain a current below about 6 amperes and a power within the range of about 2 to 40 watts when said stylus end is electrically contacted with said plate.

8. The method of claim 7 wherein said contacting and withdrawing is intermittent and repetitive.

9. The method of claim 7 wherein said ink receptive material is selected from the group consisting of carbon, compositions containing finely divided copper and its alloys, and compositions containing finely divided silicon.

10. The method of claim 7 wherein said ink receptive material is carbon in the form of particles in a binder.

11. The method of claim 10 wherein said carbon is graphite.

12. The method of claim 10 wherein said lithographic printing plate is an imaged aluminum plate.

13. A method for correcting an imaged electrically conductive lithographic printing plate by the transfer of an ink receptive material to a non-imaged area of said plate comprising contacting said plate with one end of an elongated stylus composed of solid ink receptive material and having a small cross-sectional dimension at a tip thereof adapted for electrical contact with the surface of said plate and withdrawing said tip from contact with said plate, whereby a quantity of said ink receptive material is transferred to said plate, said stylus and said plate being connected to a source of electrical energy having a potential within the range of about 2.5 to 50 volts, and said source including control means adapted to maintain a current below about 6 amperes and a power within the range of about 2 to 40 watts when said stylus tip is electrically contacted with said plate.

14. The method of claim 13 wherein said ink receptive material is an electrically conductive and partially meltable material selected from the group consisting of carbon, compositions containing finely divided copper and its alloys, and compositions containing finely divided silicon.

15. The method of claim 14 wherein said ink receptive material is carbon in the form of particles in a binder.

16. The method of claim 15 wherein said carbon is graphite.

17. The method of claim 13 wherein the contacting and withdrawing of said stylus with regard to said plate creates an electrical arc between said tip and said plate sufficient to facilitate transfer of said ink receptive material, but insufficient to burn said plate.

* * * * *